US005367290A

United States Patent [19]

Kind et al.

[11] Patent Number: 5,367,290

[45] Date of Patent: Nov. 22, 1994

[54] DEACTIVATABLE RESONANCE LABEL

[75] Inventors: Burckart C. Kind, Zürich; Philipp Müller, Burstwiesenstrasse, both of Switzerland

[73] Assignee: Actron Entwicklungs AG, Lettenstrasse, Switzerland

[21] Appl. No.: 752,505

[22] PCT Filed: Dec. 19, 1990

[86] PCT No.: PCT/CH90/00287

§ 371 Date: Aug. 20, 1991

§ 102(e) Date: Aug. 20, 1991

[87] PCT Pub. No.: WO91/09387

PCT Pub. Date: Jun. 27, 1991

[30] Foreign Application Priority Data

Dec. 20, 1989 [CH] Switzerland ..... 04565/89-4

[51] Int. Cl.[5] ..... G08B 13/187

[52] U.S. Cl. ..... 340/572

[58] Field of Search ..... 340/572

[56] References Cited

U.S. PATENT DOCUMENTS 3,624,631 11/1971 Chomet ..... 340/572
3,810,147 5/1974 Lichtblau ..... 340/572
4,567,473 1/1986 Lichtblau ..... 340/572

FOREIGN PATENT DOCUMENTS 0285559 10/1988 European Pat. Off. .
3732825A1 3/1988 Germany .
3826480A1 7/1989 Germany .

*Primary Examiner*—Glen Swann
*Attorney, Agent, or Firm*—Tarolli, Sundheim & Covell

[57] ABSTRACT

A resonance label (1) comprises an insulating support layer (4) having two sides (2, 3). A first conductor is on one side (3) of the insulating supporting layer (4) and forms a capacitor plate (**6*b*) and an induction coil (5) having a number of individual turns spaced apart from each other. A second conductor is on the other side (2) of the insulating supporting layer (4) and forms another capacitor plate (6*a*) so as to define a resonant circuit. At least one of the first and second conductors includes two adjacent conductor areas (6*a*, 7*d*) which are spaced apart at a distance (a) from each other closer to one another than the spacing between the individual turns of the induction coil (5). The distance (a) between the adjacent conductor areas (6*a*, 7*d*) defines a desired breakdown point (8) on the respective side (2) of the insulating support layer (4**).

20 Claims, 1 Drawing Sheet

DEACTIVATABLE RESONANCE LABEL

TECHNICAL FIELD

The invention relates to a resonance or resonant label.

BACKGROUND ART

Resonance labels are more particularly used in commerce for marking goods and to prevent theft. The resonance labels fixed to the goods must be deactivated at the checkout, so that no false theft alarm is triggered on leaving the sales area. Consequently this deactivation must be carried out in such a way that it is permanent and reliable. The deactivation process must not be problematical and must instead be simple and reliable to perform.

Numerous proposals have been made for carrying out the deactivation of resonance labels, in which the resonance characteristics of the resonant circuit of the label are destroyed or changed.

Thus, U.S. Pat. No. 3,624,631 describes a deactivation, in which a fuse connected in series in the resonant circuit is blown, which takes place with the aid of a wobbulator. To comply with the postal regulations alone the energy radiated must not exceed a given level. Therefore the fuse must be as small as possible, so that the Q factor and consequently the detection possibility of the resonant circuit are reduced. It must also be made from a material blowing at the energy level complying with the regulations. This represents a relatively expensive and complicated manufacture of such resonance labels, particularly if it is borne in mind that account must also be taken of the thermal conductivity of the material surrounding the fuse.

U.S. Pat. No. 3,810,147 describes a multiple resonance label, which has different frequencies for detection and deactivation. Here again deactivation takes place by the blowing of a fuse, which is located in the deactivation resonant circuit. This eliminates possible false alarms, which could occur if the detection and deactivation frequency were identical. The dimensioning of the deactivation circuit containing the fuse takes place under the standpoint that the series impedance of the induction coil and the capacitor are to be kept as low as possible, so that most of the voltage drop is available for blowing the fuse. However, this means that the induction coil must be as small as possible and the capacitor as large as possible. However, the capacitor size leads to an undesired cost increase during manufacture and also to an impracticable increase in the size of the resonance label.

A fundamentally different possibility for deactivating a resonance label is based on the fact, that with a corresponding high potential, a breakdown takes place through the dielectric located between the two conductor circuits on either side of the resonance label. To keep the potential required for deactivation as low as possible, e.g. the dielectric layer is kept particularly thin.

U.S. Pat. No. 4,567,473 describes a resonance label having a notch in the dielectric between the capacitor plates. Deactivation takes place at or close to the resonant frequency with adequate energy, so that a breakdown takes place through the dielectric at the point defined by the notch. By means of an arc discharge and subsequent evaporation processes or plasma deposition, metal should be deposited along the breakdown path, so that a permanent short-circuit path is formed and as a result the resonance characteristics of this resonant circuit are destroyed. However, the manufacture of a precisely defined notch in a thin dielectric layer is relatively complicated and costly. It has therefore been proposed to replace this by moving the two capacitor plates towards one another by pressure at certain points and therefore reduce the dielectric thickness between the plates. However, once again difficulties have occurred during manufacture, particularly as a result of the small tolerances required. Even minor thickness fluctuations and material impurities of the dielectric often do not make it possible to obtain the desired, clearly defined thickness reduction.

EP-A1-0285559 describes another variant, according to which there is provided at least one hole through the dielectric between the capacitor plates. As a result a locally bounded, but clearly defined inhomogeneity is incorporated at which the breakdown between the capacitor plates can take place. As opposed to the aforementioned U.S. Pat. No. 4,567,473, it is possible to much better control the necessary geometry during manufacture, because when making a hole no thickness tolerances with respect to the dielectric have to be taken into account. However, all the above-described deactivation variants based on any type of reducing the dielectric thickness (a further variant being described in U.S. Pat. No. 4,689,636) additionally suffer from the disadvantage that at these thickness-reduced points the resonance label is weakened and therefore may not fulfill its function, e.g. in the case of bending stress.

DE-A1-3732825 and DE-A1-3826480 describe resonance labels, in which in each case a conductor coil is covered by a deactivation conductor, an insulating layer being placed between the coil and the conductor. This insulating layer is made electrically conductive in the case of an energy signal with an appropriately chosen energy. As a result the resonance label is deactivated. These resonance labels have several, namely at least two clearly defined breakdown points. As in this deactivation process possibly only part of the induction coil fails, this can lead to a frequency shift and therefore to the triggering of false alarms.

Thus, in various ways a number of variants have been tried out and used, in order to reliably and permanently deactivate a resonance label. The clearly contradictory requirements of reliability and durability of the deactivation on the one hand and of less expensive and more easily controllable manufacture on the other have as yet always made compromises necessary.

SUMMARY OF THE INVENTION

The problem of the invention is to so construct a resonance label, that it is reliably and permanently deactivated and can be manufactured inexpensively and in a clearly defined manner. It is in particular achieved that a resonance label with such a predetermined or desired breakdown point has an easily controllable geometry, which permits a clearly defined manufacture within narrow tolerances and which is also inexpensive.

The predetermined or desired breakdown point is preferably covered by a dielectric or an insulator, so that on the one hand protection is provided against flashovers through the surrounding air and on the other hand a permanent deactivation takes place, either in the form of a durable short-circuit path or in the form of a permanent low-value resistance produced by the collapse of said dielectric.

Thus, different possibilities are provided for putting into effect the fundamental idea of forming a desired breakdown point on one of the two sides of a resonance label. It is desirable for the aforementioned reasons to keep the breakdown voltage necessary for deactivation as low as possible. Therefore the conductor areas adjacent to one another at the predetermined breakdown point must be as close as possible to one another. This gap can e.g. be cut from a continuous conductor connection in precisely defined manner with the aid of lasers or, if this process step requiring a very high precision is not desired, can be achieved in that the conductors applied in conventional manner by photoetching are made spaced from one another in the same process step at a location determining the predetermined breakdown point. In the latter case, in order to keep the necessary breakdown voltage as low as possible, a layer of conductive material can be provided between the conductive areas and which is bounded from at least one of the conductor areas and preferably also the insulating support layer by a thin coating of insulating material.

The electrical conductivity of this conductive material can be lower than the conductivity of the conductive areas. However, in place of the conductive material it is possible to provide a relatively low-value resistance layer with a resistance of e.g. max. 100 Ohm. However, also in the case of resistances up to max. 1000 Ohm a reliable deactivation is possible. The most varied materials and application methods are possible in order to obtain the electrical characteristics of the resonant circuit and the dimensioning of the desired breakdown point. Thus, e.g. an epoxy resin mixed with aluminium particles can be dripped on in thin form, i.e. a few $\mu$, an aluminium or other appropriate metal coating can be evaporated on, or in accordance with thick-film technology a resistance paste with a precious metal base can be printed on. The thickness of the insulating layer to be applied is a function of its material characteristics.

The definition of said conductive or low-value material covering the predetermined breaking point with respect to the adjacent conductor areas and preferably also the insulating carrier layer preferably takes place by a thin insulating material coating. The latter can e.g. be a varnish or ink coating, which is applied by dripping, printing or hot embossing. However, it can also be formed by the oxidized marginal zones of the conductor. However, an insulating, e.g. UV-hardenable ink coating can also be printed, preferably twice, between the two conductive areas and then, in displaced manner, a conductive, preferably also UV-hardenable, ink coating is printed on and in particular this takes place twice. This conductive ink coating is consequently in conductive contact with one of the two conductive areas, whereas it is spaced from the other conductive area by the insulating ink coating. There is a considerable simplification of the manufacturing process because different ink coatings can be applied with in each case a thickness of $2\mu$ in a single operation on a multicolour printing press. Coating thicknesses of in each case $4\mu$ are obtained when printing takes place twice.

Thus, through the formation of the desired breakdown point between two conductive areas on the same side of a resonance label, all the aforementioned difficulties due to complicated geometry are obviated.

A covering of the resonance label on the side having the desired breakdown point by a foil or film, which can e.g. be made from paper and therefore simultaneously serves to receive a product marking, price or the like, protects the label and the short-circuiting bridge against mechanical stressing and any possible subsequent breakage. The short-circuiting bridge is consequently provided in a durable and reliable manner.

BRIEF DESCRIPTION OF THE DRAWINGS

The invention is described in greater detail hereinafter relative to the drawings, wherein show.

DESCRIPTION OF THE PREFERRED EMBODIMENTS

Figure 1:
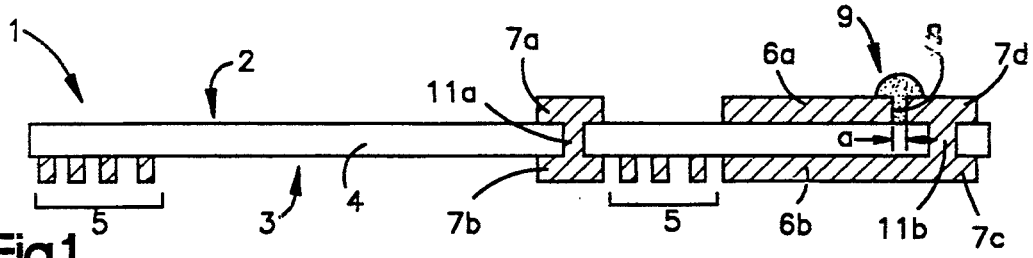
FIG. 1 a longitudinal section through an inventive resonance label.

The resonance label 1 shown in cross-section in FIG. 1 has conductive areas on two sides 2,3 separated by an insulating support layer 4 and which in per se known manner form an induction coil 5 and a capacitor 6. The two capacitor plates *6a* and *6b* are separated by the support layer 4, which e.g. is made from polyethylene. Two contact tags *7a*,*7b* on the top 2 or bottom 3 of the resonance label 1 are conductively interconnected through the support layer 4, e.g. by crimping (junction *11a*). One contact tag *7a* is connected to the capacitor plate *6a* and the other contact tag *7b* to the turns of the induction coil 5. Two further contact tags *7c*,*7d* are formed on the two capacitor plates *6b*,*6a*. One of the two tags *7c* is in direct electrical connection with one capacitor plate *6b*, whilst a space a is provided between the other tag *7d* and the adjacent capacitor plate *6a*. This space a is only fractions of a $\mu$ and preferably in the range 0.1 to $1\mu$. The two contact tags *7c*,*7d* are electrically conductively connected through the support layer 4 in the same way as the two other tags *7a*,*7b* (conductive joints *11b*,*11a*). If by means of a wobbulator the resonance label is traversed by sufficient energy, e.g. in the form of an energy surge, as disclosed by EP-A1-0287905, then at the predetermined breakdown point 8 a breakdown occurs and consequently as a result of the evaporated conductor metal deposited on the side of the support layer 4 a permanent short-circuiting bridge is formed.

It is advantageous to cover the desired breakdown point 8 by a dielectric 9 or an insulator, so that a particularly durable short-circuiting bridge is formed. This dielectric 9 covering the desired breakdown point 8 can have a dielectric constant diverging from that of the support layer 4. It could also be advantageous, in order to minimize any contact surface problems, to make the support layer 4 and the dielectric 9 from the same material, i.e. so as to have the same dielectric constant. For building up a particularly durable short-circuiting bridge, it is sufficient to have a local covering of the desired breakdown point 8. However, from the manufacturing standpoint, it may be advantageous to cover the entire top 4 of the resonance label 1 by a dielectric or insulating layer.

Another possibility for deactivating the resonance label 1 is for the material for the dielectric 9, which covers the desired breakdown point 8, to be of a type which perforates at a correspondingly high, induced breakdown voltage and passes into a permanent, low-value resistor.

Figure 2:
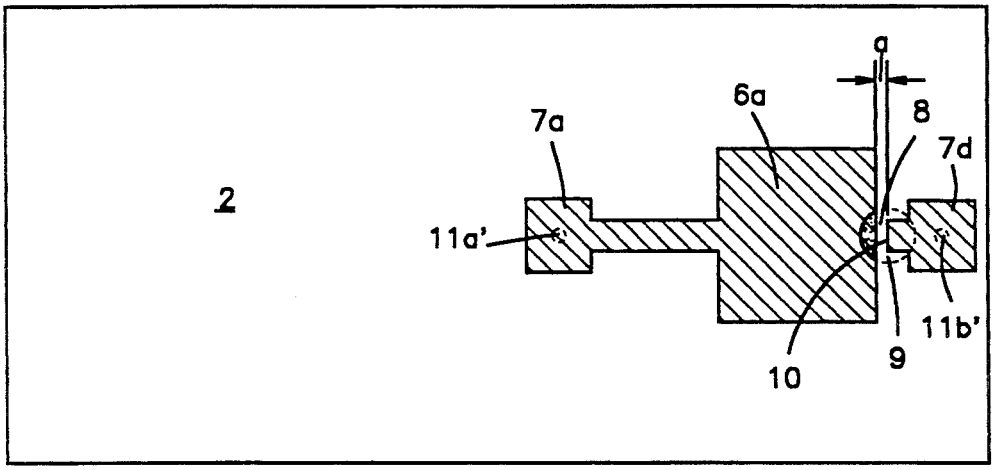
FIGS. 2 and 3 the top and bottom of this resonance label.

FIG. 2 shows the side 2 of the resonance label 1 with the capacitor plate 6*a*, the connected contact tag 7*a* and the contact tag 7*d* separated by the desired breakdown point from the capacitor plate 6*a*. The desired breakdown point 8 is cut from a short conductor portion 10, preferably by means of a laser. The dielectric 9 covers the desired breakdown point 8, the adjacent conductive areas on the capacitor plate 6*a*, conductor portion 10, tag 7*d* and the corresponding areas of the support layer 4 in a given perimeter in a complete manner. The conductive junctions 11*a*' and 11*b*' in each case connect the contact tag pairs 7*a*,7*b* and 7*d*,7*c* at the top 2 and bottom 3 of the resonance label 1.

Figure 3:
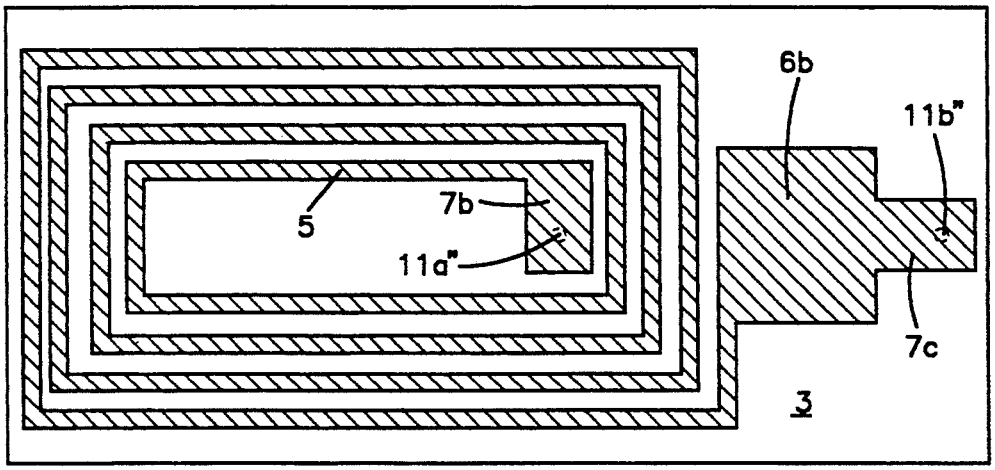

FIG. 3 shows the corresponding arrangement of an induction coil 5 and a second capacitor plate 6*b* with the associated contact tags 7*b* or 7*c* and their conductive junctions 11*a*'' and 11*b*'' on the bottom 3 of the resonance label 1.

Figure 4:
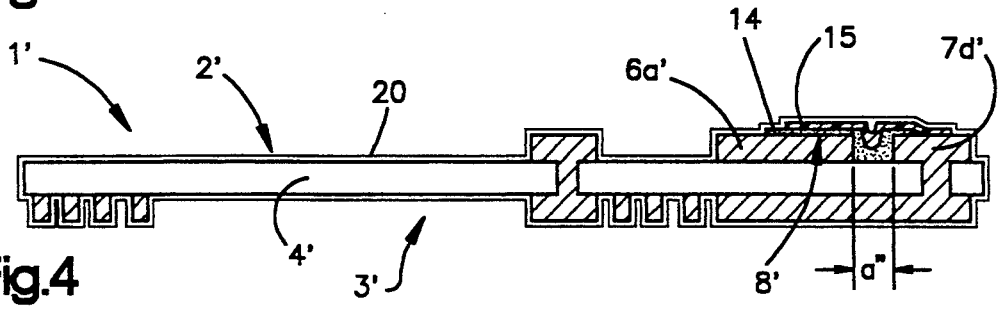
FIG. 4 a longitudinal section through another variant of the inventive resonance label.

FIG. 4 shows another variant of a deactivatable resonance label, which has a clearly defined desired breakdown point 8''. The gap a'' between the contact tag 7*d*'' and the capacitor plate 6*a*'' is between a few tenths of a millimeter and approximately 1 mm. An insulating layer 14 is placed between the two conductor areas 6*a*'' and 7*d*'' and in part also on them and is preferably in the form of a UV-hardenable, twice printed ink coating with a thickness of approximately 4μ (i.e. 0.5 to 5). Above it is provided an electrically conductive layer 15, which is in electrically conducting contact with one of the two conducting areas, in this case 7*d*'', whereas it is insulated by the interposed insulating layer 14 against the other conducting area, in this case the capacitor plate 6*a*''. The deactivation of this resonance label takes place in the manner described hereinbefore, breakdown taking place between the conductive layer 15 and the capacitor plate 6*a*''. The conductive layer 15 is preferably a UV-hardenable, particularly twice printed ink coating. The application of two ink coatings, one insulating 14 and one conductive 15, can take place in a single process on a printing press. The ink coating thickness is e.g. approximately 4μ in each case.

The electrically conductive layer 15 can be made from an electrically conductive material, whose electrical conductivity is lower than that of the adjacent conductor areas 6*a*'' and 7*d*'', but is high compared with an insulator or dielectric. Thus, suitable conductive materials for the layer 15 are e.g. epoxy resin mixed with aluminium particles, precious metal-based resistance pastes known from thick-film technology and evaporated on aluminium or other metal coatings. The restricting insulating layer 14 can be an insulating varnish or ink layer, or can be formed by oxidation of the free sides of the conductor area 6*a*'' and 7*d*''.

The capacitor 6 is located outside the induction coil 5 in the described resonance labels 1. Obviously, in known manner, the capacitor could also be positioned within the induction coil. In known manner there could be more than one induction coil and more than one capacitor on the top and/or bottom of the resonance label. The arrangement of the desired breakdown point 8 on the upper capacitor plate 6*a* according to FIG. 2 is only an exemplified possibility of the inventive resonance label. The invention also covers any other possibility of providing the desired breakdown point, provided that it is located between two conductive areas on one of the two sides of the resonance label. There can also be more than one desired breakdown point, namely either on one of the two sides or also on both sides.

In each of the described variants the durability of the deactivation is very important. Thus, in particular the desired breakdown point should be protected by an additional film (shown in the variant of FIG. 4 only), which covers the entire resonance label. This film, which can also be e.g. of foil or paper ensures that in the case of any mechanical stressing of the resonance label, there is no subsequent breakage and destruction of the short-circuiting bridge.

We claim:

1. Resonance label (1) comprising:

an insulating support layer (4) having two sides (2,3);

a first conductor on one side (3) of the insulating supporting layer (4) and forming a capacitor plate (6*b* ) and an induction coil (5) having a number of individual turns spaced apart from each other;

a second conductor on the other side (2) of the insulating supporting layer (4) and forming another capacitor plate (6*a* ) so as to define a resonant circuit;

at least one of the first and second conductors including two adjacent conductor areas (6*a*, 7*d*) which are spaced apart at a distance (a) from each other closer to one another than the spacing between the individual turns of the induction coil (5), the distance (a) between the adjacent conductor areas (6*a*, 7*d*) defining a desired breakdown point (8) on the respective side (2) of the insulating support layer (4).

2. Resonance label according to claim 1 wherein the desired breakdown point (8) is defined in the vicinity of the respective capacitor plate (6*a*).

3. Resonance label according to claim 1 wherein the desired breakdown point (8'') is covered with an electrically conductive material (15) which is insulated by a thin insulating layer (14) against one of the conductive areas.

4. Resonance label according to claim 1 wherein the desired breakdown point (8) and the adjacent conductor areas (6*a*, 7*d*) are covered by a dielectric (9).

5. Resonance label according to claim 4 wherein the dielectric (9) is made from a material which perforates at a breakdown voltage determined by the dimensioning of the resonance label (1) and passes into a permanent, low-value resistor.

6. Resonance label according to claim 5 wherein the distance of (a'') between the adjacent conductor areas (6'', 7*d*'') at the breakdown point (8'') is at most 3 mm.

7. Resonance label according to claim 6 wherein the distance (a'') between the adjacent conductor areas (6*a*'', 7*d*'') at the breakdown point (8'') is between 0.1 to 0.5 mm.

8. Resonance label according to claim 1 wherein the distance (a) between the adjacent conductor areas (6*a*, 7*d*) at the breakdown point (8) is at most 5μ.

9. Resonance label according to claim 8 wherein the distance between the adjacent conductor areas (6*a*, 7*d*) at the breakdown point (8) is between 0.1 to 0.5μ.

10. Resonance label according to claim 1 wherein the desired breakdown point (8'') is covered with an electrically conductive layer (15) which has a resistance value of at most 1,000 Ohms and which is insulated by a thin insulating coating (14) from the conductive areas.

11. Resonance label according to claim 10 wherein the electrically conductive layer (15) comprises an epoxy resin mixed with aluminum.

12. Resonance label according to claim 10 wherein the thin insulating coating (14) comprises an insulating varnish.

13. Resonance label according to claim 10 wherein the insulating coating (14) is formed by oxidation of the free sides of the conductor areas (*6a''*, *7d''*) bounding the desired breakdown point (8'').

14. Resonance label according to claim 10 wherein the electrically conductive layer (15) has a resistance value of approximately 100 Ohms.

15. Resonance label according to claim 10 wherein the thin insulating coating (14) is between 0.5 to 5μ thick.

16. Resonance label according to claim 10 wherein the electrically conductive layer (15) comprises metal particles.

17. Resonance label according to claim 10 wherein the electrically conductive layer (15) comprises a resistance paste.

18. Resonance label according to claim 10 wherein the thin insulating coating (14) comprises an insulating ink.

19. Resonance label according to claim 1 wherein the resonance label is covered on the side having the desired breakdown point by a film.

20. Resonance label according to claim 19 wherein the film comprises paper material.

* * * * *